US009702053B2

(12) United States Patent
Maloney et al.

(10) Patent No.: US 9,702,053 B2
(45) Date of Patent: Jul. 11, 2017

(54) ELIMINATION OF CRAZING IN ANODIZED LAYERS

(75) Inventors: Max A. Maloney, San Francisco, CA (US); Dong-Jin Sung, Woonsocket, RI (US)

(73) Assignee: Apple Inc., Cupertino, CA (US)

( * ) Notice: Subject to any disclaimer, the term of this patent is extended or adjusted under 35 U.S.C. 154(b) by 921 days.

(21) Appl. No.: 13/539,021

(22) Filed: Jun. 29, 2012

(65) Prior Publication Data

US 2014/0001052 A1 Jan. 2, 2014

(51) Int. Cl.

| | |
|---|---|
| ***C25D 11/18*** | (2006.01) |
| ***C25D 11/24*** | (2006.01) |
| ***C25D 11/26*** | (2006.01) |
| ***C25D 11/30*** | (2006.01) |

(52) U.S. Cl.

CPC ..... *C25D 11/243* (2013.01); *C25D 11/246* (2013.01); *C25D 11/26* (2013.01); *C25D 11/30* (2013.01)

(58) Field of Classification Search

CPC ..... C25D 11/246

See application file for complete search history.

(56) References Cited

U.S. PATENT DOCUMENTS

2001/0047123 A1* 11/2001 Abe et al. ..... 600/101
2003/0155669 A1* 8/2003 Bronshtein et al. ..... 264/4.1

FOREIGN PATENT DOCUMENTS

| | | |
|---|---|---|
| DE | 19612646 | 10/1997 |
| FR | 1494711 | 9/1967 |
| JP | 2009138229 | 6/1999 |
| WO | WO99/10567 | 3/1999 |

OTHER PUBLICATIONS

"Introduction to Temperature Controllers" accessed from http://www.omega.com/temperature/Z/pdf/z110-114.pdf (2003).*

International Search Report, PCT Application No. PCT/US2013/047652, 4 pages, Sep. 30, 2013.

* cited by examiner

*Primary Examiner* — Bryan D. Ripa

(74) *Attorney, Agent, or Firm* — Downey Brand, LLP

(57) ABSTRACT

Embodiments may generally take the form of systems and techniques for reducing or eliminating crazing in anodized metal. In particular, one embodiment may take the form of a method for sealing an anodized metal member including placing the anodized metal member in a sealing bath having water. The sealing bath initially has a first temperature that is less than a sealing temperature. The method also includes continuously heating the sealing bath to the sealing temperature, maintaining the bath at the sealing temperature for a period of time, and removing the anodized metal member from the sealing bath after the period of time has lapsed.

19 Claims, 5 Drawing Sheets

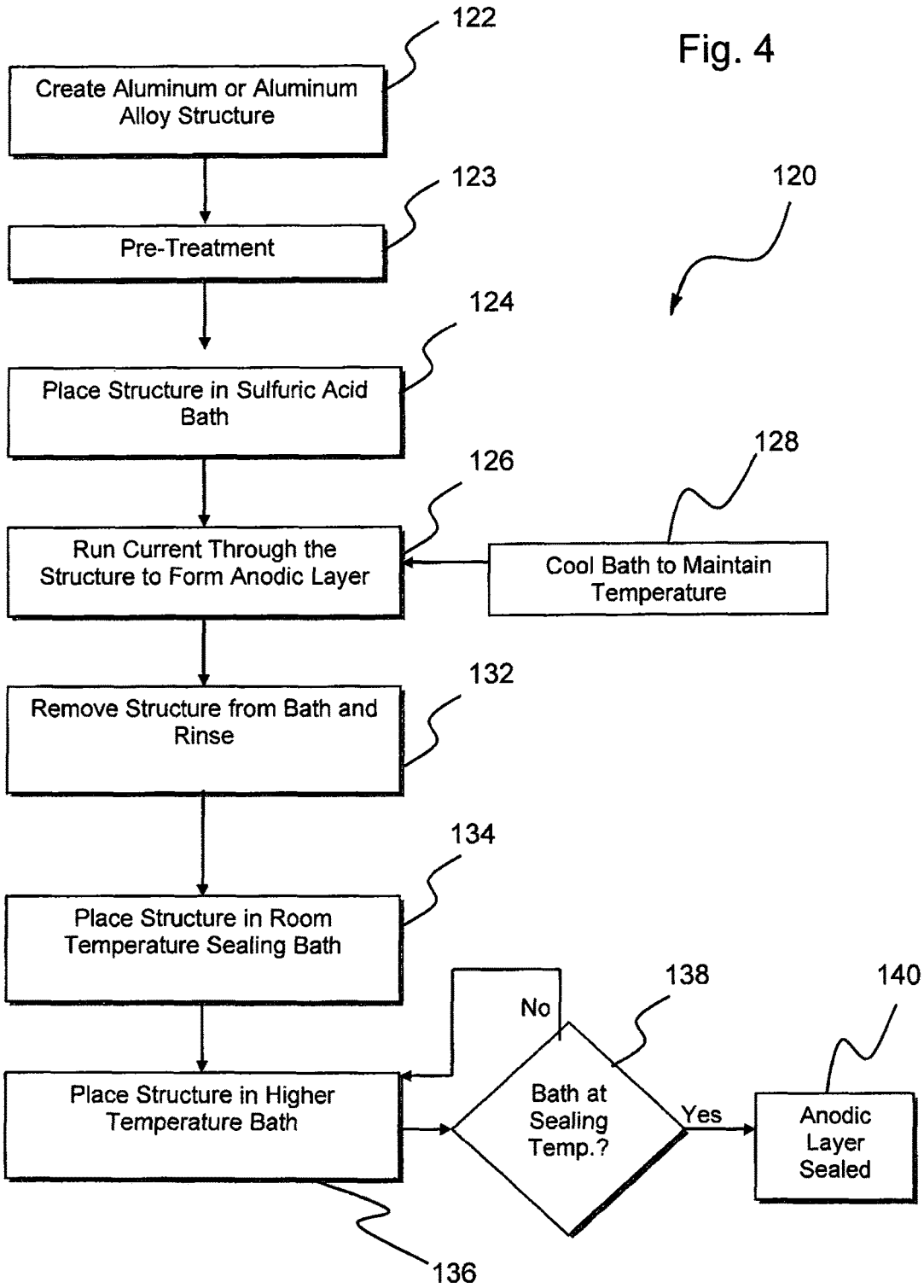
Fig. 4
120
122
Create Aluminum or Aluminum Alloy Structure
123
Pre-Treatment
124
Place Structure in Sulfuric Acid Bath
126
Run Current Through the Structure to Form Anodic Layer
128
Cool Bath to Maintain Temperature
132
Remove Structure from Bath and Rinse
134
Place Structure in Room Temperature Sealing Bath
136
Place Structure in Higher Temperature Bath
138
Bath at Sealing Temp.?
No
Yes
140
Anodic Layer Sealed

ELIMINATION OF CRAZING IN ANODIZED LAYERS

TECHNICAL FIELD

The present invention relates generally to anodized metals and, more specifically, to reducing or preventing crazing in anodized metals.

BACKGROUND

An oxide layer can be grown on a metal substrate in an anodizing process. The last step in an anodizing process is typically a sealing of the porous, anodized structure. There are several methods of sealing that may be implemented. In particular, there are both cold and hot sealing methods. Generally, the hot sealing processes involve elevated temperature baths (up to 90-100° C.) of either pure water or water plus a chemical additive such as nickel acetate. These hot sealing methods cause a rapid expansion of the metal and can result in cracking of the newly-formed oxide layer covering the part. The cracking occurs because the coefficient of thermal expansion of the oxide layer is much lower than that of the underlying metal (e.g., the thermal expansion of aluminum oxide is approximately one-fifth that of aluminum). This thermal-shock induced cracking is typically known as 'crazing'.

Generally, cold sealing methods do not induce crazing like the hot seal techniques as both the metal and the oxide layers are maintained at lower temperatures so that they are not expanding. However, it should be appreciated that there is a risk of crazing at any temperature above room temperature. As such, even if a product is sealed by a cold sealing process, exposure to hot and cold cycles throughout the life of the anodized product may lead to crazing.

In many applications, the crazing may not be noticeable or may not otherwise impact the functionality of the metal member. For example, in some cases, the oxide layer is relatively thin and does not experience severe crazing. In other cases, the oxide layer may be dyed so that any crazing is generally imperceptible. However, crazing is generally an undesirable cosmetic and functional defect that may detract from the aesthetically appeal of an anodized metal surface.

SUMMARY

Embodiments may generally take the form of systems and techniques for reducing or eliminating crazing in anodized metal. In particular, one embodiment may take the form of a method for sealing an anodized metal member including placing the anodized metal member in a sealing bath having water. The sealing bath initially has a first temperature that is less than a sealing temperature. Specifically, the temperature of bath is low enough that crazing is not caused with the part is initially immersed in the bath. The method also includes continuously heating the sealing bath to the sealing temperature, maintaining the bath at the sealing temperature for a period of time, and removing the anodized metal member from the sealing bath after the period of time has lapsed.

Another embodiment may take the form of a method of sealing an anodic layer. The method includes placing an anodized metal member in a first sealing bath. The first sealing bath has a first temperature that is less than a sealing temperature. The method also includes removing the anodized metal member from the first sealing bath and placing the anodized metal member in a second sealing bath. The second sealing bath has a second temperature which is the sealing temperature. The anodized metal member is left in the second sealing bath for a period of time to complete the sealing process. It should be appreciated further that multiple intermediate steps which progressively heat the anodic layer may be included in this embodiment.

Yet another embodiment may take the form of a method for creating a sealed, anodized aluminum member. The method includes anodizing an aluminum member to form an anodized aluminum member, rinsing the anodized aluminum member, dyeing an anodic layer of the anodized aluminum member, and rinsing the dyed anodic layer. Additionally, the method includes sealing the anodized aluminum member. The sealing step may take the form of continuously heating a sealing bath from a first temperature to a sealing temperature.

Still another embodiment may take the form of a system for creating a sealed, anodized metal member. The system includes an anodizing bath, a first rinse bath, a sealing bath, and a heating apparatus for heating the sealing bath. The heating apparatus is configured to heat the sealing bath from a first temperature that is less than a sealing temperature to a sealing temperature while the anodized member is in the sealing bath.

While multiple embodiments are disclosed, still other embodiments of the present invention will become apparent to those skilled in the art from the following Detailed Description. As will be realized, the embodiments are capable of modifications in various aspects, all without departing from the spirit and scope of the embodiments. Accordingly, the drawings and detailed description are to be regarded as illustrative in nature and not restrictive

BRIEF DESCRIPTION OF THE DRAWINGS

FIG. 4 is a flowchart illustrating a method for anodizing and sealing a metal member.

DETAILED DESCRIPTION

Figure 1:
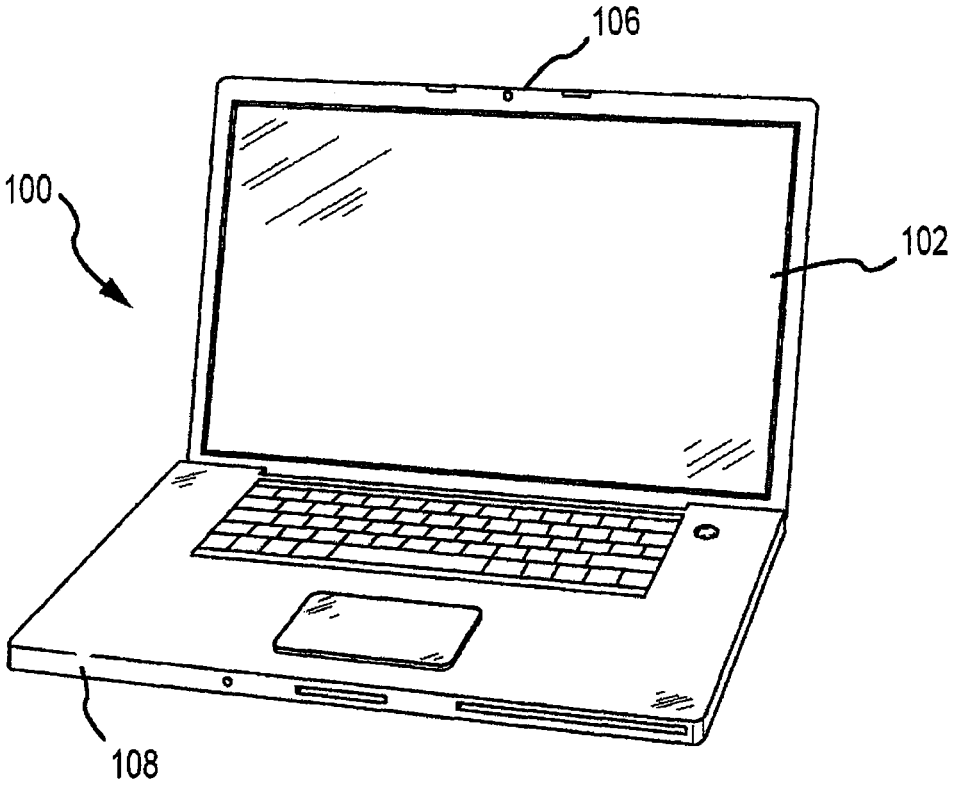
FIG. 1 illustrates an example electronic device having an anodized aluminum member.

Embodiments may take the form of a sealing process that reduces or eliminates crazing in oxide layers. The process may generally include gradually warming the aluminum oxide from a first temperature to sealing temperature to eliminate thermal shock experienced by the aluminum oxide. In one example embodiment, the aluminum oxide may be submersed in one or more heated water tanks spanning the temperature range from room temperature (e.g., approximately 20° C.) to sealing temperature (e.g., approximately 90-100° C.). As may be appreciated, mid-temperature seals may occur at temperatures between room temperature and 90° C. and crazing may possibly occur at any temperature above room temperature. In another embodiment, the aluminum oxide may be submersed in one tank of purified water at room temperature or slightly heated purified water, which is heated with the aluminum oxide submerged. In each example, the tanks may also include a sealing chemical.

Any suitable means to gradually raise the temperature of the part from room temperature to sealing temperature may be implemented, including inductive heating, heated air, electrical resistance heating, and so forth. Using the gradual heating processes, the oxide parts emerge from sealing with reduced or completely eliminated crazing when compared to an identical part undergoing the same pretreatment and anodizing process, but a normal sealing process. Further, the sealed parts are less susceptible to crazing during the lifetime of the part.

The anodizing process is an electrolytic passivation process where a metal member operates as an anode in an electrical circuit and an oxide layer is grown on the surface of the member. The anodizing process is commonly used to create an anodic film on aluminum alloys, but may also be implemented to create anodic films on titanium, zinc, magnesium, niobium, zirconium, hafnium and tantalum. The anodic film increases corrosion and wear resistance and provides a porous surface for coloring (dyeing), among other characteristics.

Although the following discussion is directed to aluminum oxide formed through an anodizing process, it should be appreciated that the techniques and processes discussed may be implemented with other metals and/or metal alloys that similarly have an anodic layer formed through anodizing or other processes.

Generally, anodized aluminum may be defined by a range of different categories. Specifically, there are several different specifications that define a set of tests and quality assurance measures that the anodic layers of each category meet. In the U.S. Military specification, MIL-A-8625 the three categories include a chromic acid anodization (Type I), a sulfuric acid anodization (Type II), and a sulfuric acid hardcoat anodization (Type III). The Type I aluminum oxide is a thinner, e.g., 0.5 micrometers to 18 micrometers, and more opaque film that may be softer than other types. Type II aluminum oxide has a thickness between approximately 1.8 micrometers to approximately 25 micrometers and is formed using a sulfuric acid bath having temperatures near 68-70 degrees Fahrenheit with a current density of 10-15 amps/ft$^2$. Type III aluminum oxide is generally greater than 25 micrometers thick and is produced in a refrigerated tank with higher voltages than the thinner coatings. For example, Type III aluminum oxide is generally produced at temperatures between 32-40 degrees with a current density of 25+ amps/ft$^2$. Consumer products typically utilize Type II anodized aluminum and, as such, the Type II anodized aluminum is commonly referred to a cosmetic anodized layer. Industrial items such as pistons are made of Type III anodized aluminum and are commonly dyed black.

FIG. 1 illustrates an example electronic device 100. The device 100 may include a display 102 and an anodized aluminum housing 106, 108. The example electronic device 100 may generally take the form of a notebook computer, such as the MacBook Pro® produced by Apple, Inc. It should be appreciated, however, that the present techniques and processes may be utilized on any anodized aluminum member and should not be limited to the example embodiments discussed herein.

Figure 2:
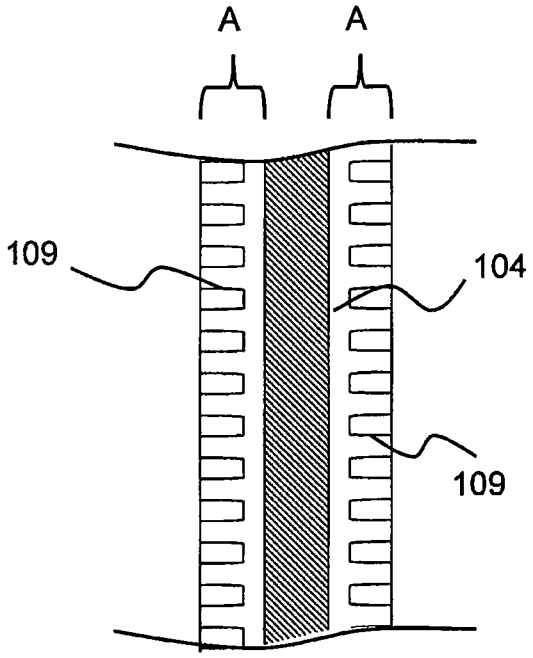
FIG. 2 illustrates a partial cross-sectional view of an anodized aluminum member.

FIG. 2 illustrates an example, partial cross-sectional view of an anodized aluminum part 104. As shown, the core of the part 104 is aluminum and the outside portions 109 are oxide layers. The oxide layers 109 are porous. The oxide layers 109 of the anodized aluminum member 104 may generally have a thickness A of that is two to four time larger than those conventionally produced for Type II anodized aluminum. The larger anodic layer provides increased durability over thinner oxide layers. In some embodiments, the anodic layer may be approximately 35-40 micrometers thick. It should be appreciated, however, that crazing may occur in an oxide layer having any thickness and, as such, the present techniques may be applicable to all sizes of oxide layers.

The anodized aluminum member 104 may be produced by driving a current through an aluminum alloy member while it is in a sulfuric acid bath. The current may be a direct current (DC), an alternating current (AC), or some combination of the two. The bath may be cooled and kept at a nearly constant temperature during the anodizing process. The anodic layer formed through this process may have a clear finish that is both hard and relatively thick.

In the anodization process, the surface of the aluminum or aluminum alloy is anodized to form an anodic layer on the surface. This anodic layer is pushed outward from the aluminum or aluminum alloy as the anodizing process continues. As such, the first anodic layer that is formed remains as the outermost surface upon completion of the process. As the anodizing process proceeds and the outermost anodic layer is pushed outward, the tensile stress on the outermost anodic layer increases. This is especially true when there are curves or bends in the underlying aluminum or aluminum alloy and the anodic layer is relatively thick.

As such, curves or bends are highly susceptible to crazing due to the increased tensile stress caused by the anodic layer's growth. Any micro-fractures or other defects in the outer surface may be exacerbated by this stress, especially when the part is heated as the underlying aluminum 104 or aluminum alloy has a much higher coefficient of thermal expansion than the anodic layer. To avoid a rapid thermal expansion, the part may be sealed in a stepwise or continuous heating scheme which reduces or eliminates the crazing.

Figure 3:
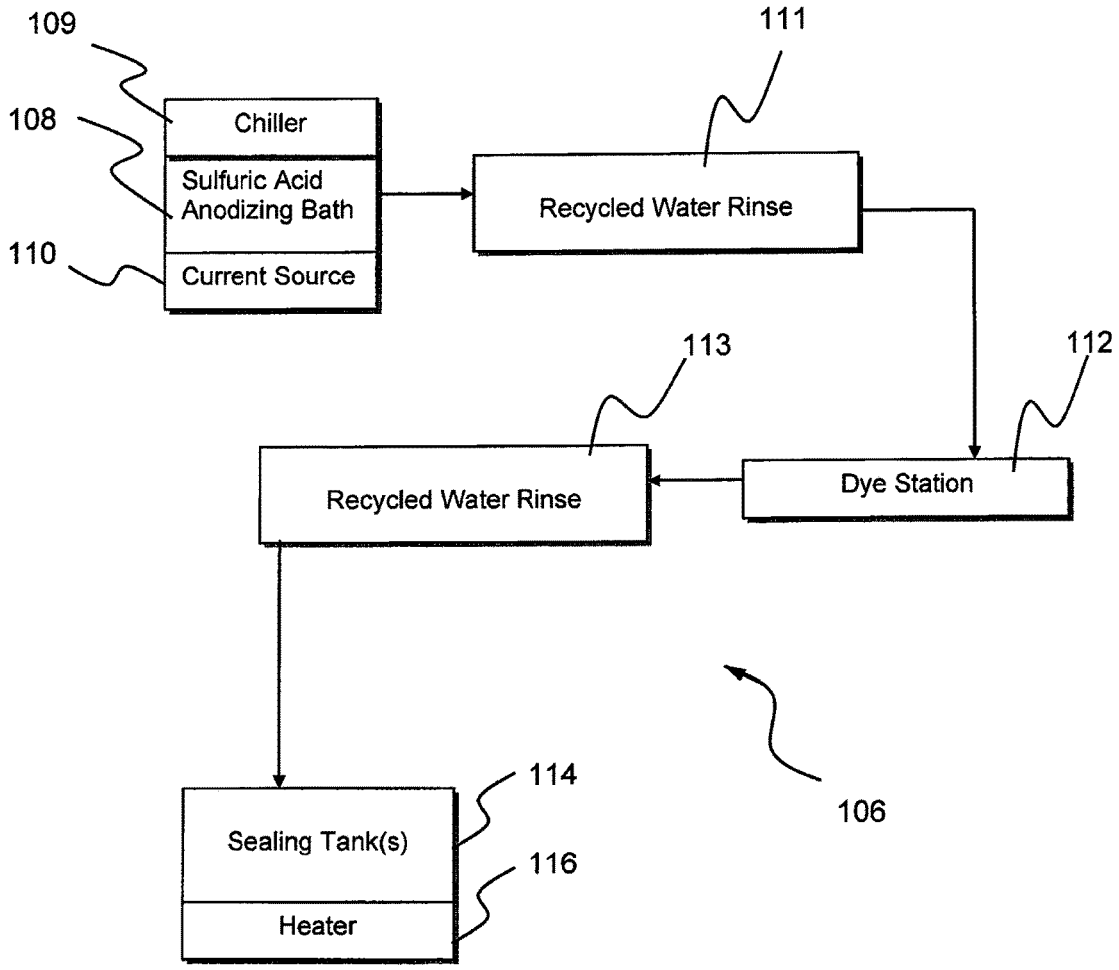
FIG. 3 is a system flow diagram illustrating an anodizing and sealing system.

FIG. 3 illustrates an example anodization and sealing system 106 for aluminum and aluminum alloys. The system 106 includes a sulfuric acid anodizing bath 108. A chiller 109 and current source 110 may be associated with the anodizing bath 108 to cool the bath and to provide an electrical current to the aluminum member, respectively. A first recycled water rinse 111 is provided to clean the anodized aluminum. Generally, the recycled water rinse 111 may include multiple sections or tanks, each with recycled water, that are progressively cleaner. A dye station 112 may be provided which allows the aluminum member to be colored. Generally, anodized aluminum is porous so the dye is absorbed well. A second recycled water rinse 113 may be provided after the dye station. One or more sealing tanks 114 with heater(s) 116 are provided to seal the anodized aluminum. In some embodiments, a single tank may be provided with a heat source that ramps the temperature in a continuous manner to a sealing temperature. In other embodiments, discrete tanks having different temperature profiles are provided and the anodized aluminum is moved from one tank to the next in a sequential manner according to the temperature of the tanks.

FIG. 4 is a flowchart illustrating an example method 120 for creating an anodized aluminum member with reduced crazing. Initially, the aluminum member is created (Block 122). It should be appreciated that the aluminum member may take the form of a suitable aluminum alloy. Further, in other embodiments, other metals and alloys may be formed and the method 120 may be equally applicable to them.

Once the aluminum member is formed, one or more pretreatment steps may be performed depending on the desired finish (Block 123). Some example pretreatment processes include, but are not limited to, alkaline etching, acid etching, chemical polishing, bright dipping and desmutting. It may be placed in an anodization bath (Block 124) and an electrical current may be passed through the aluminum member (Block 126). The anodization bath may be cooled (Block 128) to help maintain the bath with a desired temperature profile. The anodization bath may generally include a sulfuric acid bath which promotes oxidation of the aluminum to form the anodic layer. The current may be AC, DC or some combination of the two. The anodization bath may be maintained at temperatures between approximately 0-30 degrees Celsius. Additionally, as the current passes through the aluminum member, resistive heat is generated which warms the bath. As such, the cooling of the bath helps to maintain a constant or nearly constant temperature.

The aluminum member is removed from the anodizing bath and rinsed (Block 132) to remove the acid and stop the anodization process. The rinsed aluminum member may then be transferred into a sealing bath (Block 134). In some embodiments, the sealing bath may be at room temperature. In other embodiments, the sealing bath may be preheated. For example, the sealing bath may be preheated to approximately 38 degrees Celsius (e.g., approximately 100 degrees Fahrenheit). The sealing bath may take any suitable form. In some embodiments, the sealing bath may take the form of a purified water bath. In another embodiment, the sealing bath may include both purified water and a sealing agent, such as nickel acetate. It should be appreciated that there may be multiple different sealing temperatures at which an anodic layer is sealed. Accordingly, although the temperatures between 90-100 degrees Celsius are generally discussed as examples, there may be many other sealing temperatures at which a part may be sealed at temperatures less than 100 degrees Celsius. Additionally, there may be processes where the sealing temperature is over 100 degrees Celsius.

Once the parts reach a sealing temperature, they are maintained at the sealing temperature for a period of time until they are fully sealed. After the period of time passes, the aluminum member is transferred to another bath having a higher temperature (Block 136). The length of time that the aluminum member stays in the bath will correspond with the length of time it takes to raise the temperature of the aluminum member to the temperature of the bath. In the method 120, there may be multiple steps (e.g., baths) to raise the temperature of the aluminum member from first bath to the sealing temperature; the last bath in the process is at the sealing temperature. If the aluminum member is removed from a bath at the sealing temperature (Block 138), upon removal from the bath the aluminum member is sealed (Block 140). If the bath was not at the sealing temperature (Block 138), the aluminum member is placed in a bath with a higher temperature (Block 136). The sealing temperature is at or near boiling (e.g., approximately 100 degrees Celsius).

There may be any number of steps in the method 120 to raise the temperature of the aluminum member from room temperature to sealing temperature. In some embodiments, a two step process is implemented with a first step being 38 degrees Celsius and the second step being 100 degrees Celsius. In another embodiment, a three step process may include steps at 38 degrees Celsius, 69 degrees Celsius, and 100 degrees Celsius. In yet another embodiment, a four step process may include steps at 38 degrees Celsius, 59 degrees Celsius, 80 degrees Celsius and 100 degrees Celsius. In still another embodiment, a five step process may include steps at 38 degrees Celsius, 53.5 degrees Celsius, 69 degrees Celsius, and 84.5 degrees Celsius and 100 degrees Celsius. In each example embodiment, the steps are approximately equidistance in terms of temperature. However, it should be appreciated that in other embodiments this may not be so.

Figure 5:
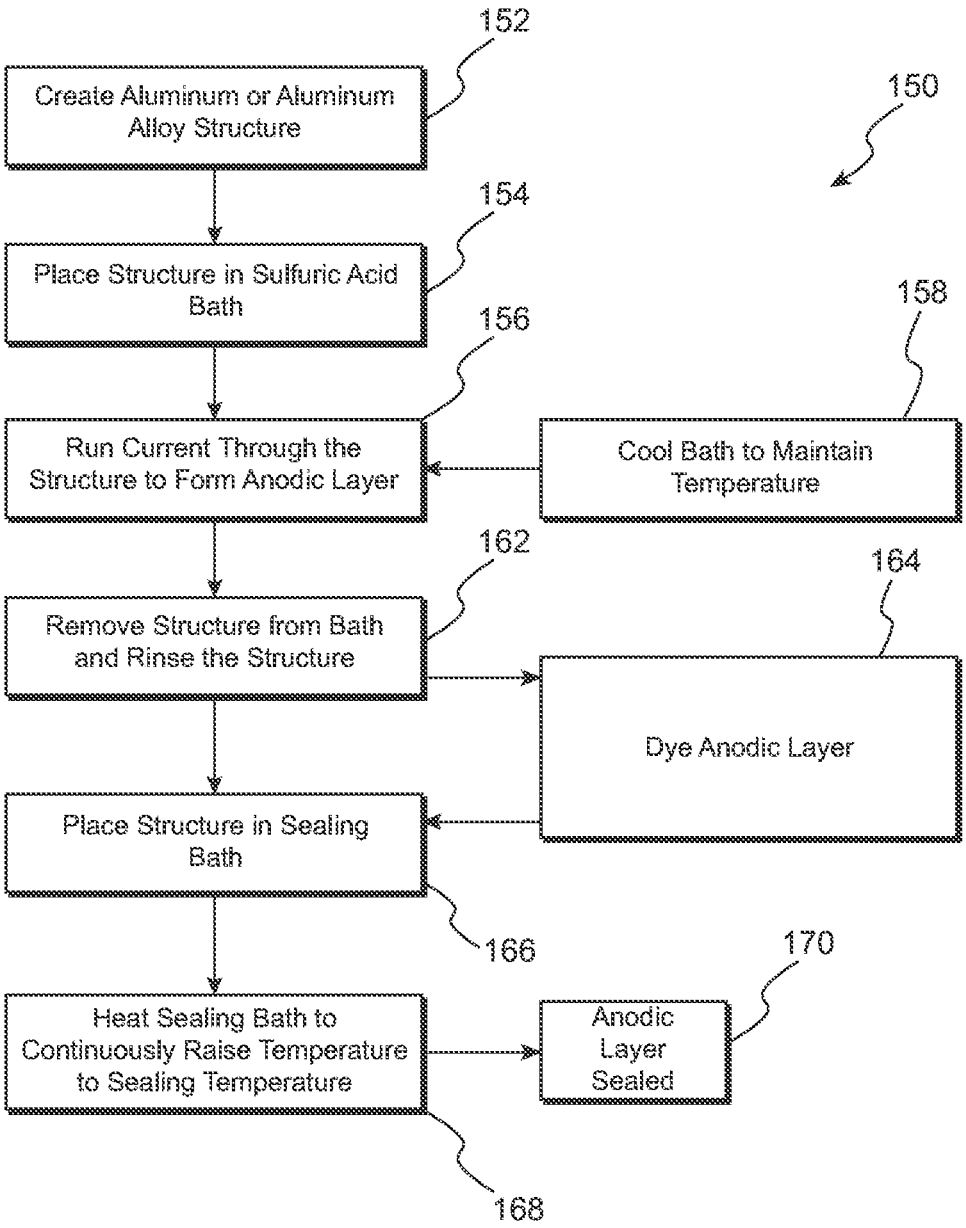
FIG. 5 is a flowchart illustrating an alternative method for anodizing a sealing a metal member.

FIG. 5 illustrates another example method 150 for sealing anodized aluminum to reduce or eliminate crazing. In the method 150, the steps in Blocks 152-162 generally correspond with the steps in Blocks 122-132 of method 120. As such, they will not be further described here but reference may be made to the corresponding steps of method 120 set forth above for further details. After the aluminum member has been rinsed (Block 162), the member may be dyed (Block 164). The porous anodic layer is well suited to dying at this stage, as it readily absorbs the dye. A dyeing bath may be maintained at a constant temperature, such as approximately 55 degrees Celsius, to control the color that is absorbed into the anodic layer. It should be appreciated that one or more rinse steps may be provided after the dyeing step although they are not shown. Additionally, method 120 may include dyeing and rinsing steps as well.

The aluminum member is then placed in a sealing bath (Block 166). The sealing bath may be at room temperature or may be preheated. For example, the sealing bath may be preheated to approximate 38 degrees Celsius. The preheated sealing bath, however, is not heated to a sealing temperature. That is the preheated bath may be heated to some temperature less than the boiling point of water. The preheated bath is intended to heat the aluminum member without the aluminum member incurring significant thermal shock which may cause crazing.

Once the aluminum member is in the sealing bath, the sealing bath is heated in a continuous manner to raise the temperature to a sealing temperature (Block 168). The heating of the sealing bath may be accomplished in any suitable manner. The aluminum member remains in the sealing bath for a determined period of time upon reaching the sealing temperature. The length of time will depend upon the thickness of the anodic layer. Once the time has lapsed, the aluminum member is removed and the anodic layer is sealed (Block 170).

The heating of the sealing bath may be performed at one or more rates based on the thickness of the anodic layer. That is the rate at which the sealing bath is heated may depend on the thickness of the anodic layer. For example, an anodic layer that is 35 micrometers thick may be heated at a higher rate than an anodic layer than an anodic layer that is 40 micrometers thick.

In alternative embodiments, the anodized part may be preheated prior to being placed in the sealing bath. For example, the part may be placed in or passed through an air oven. In other embodiments, the part may be heated with steam. In still other embodiments, the part may be heated through induction or radiation (e.g. infrared radiation). Further still, other embodiments may include heating the part by combusting gas (e.g., placing bath over a burner). In some embodiments, a combination of multiple heating techniques may be employed. For example, a first method may be employed to heat the part through a first heating stage and a second method, which may be more finely controlled, may be employed as the part nears the sealing temperature.

Increasing the size of the anodic layer, while trying to provide an aesthetically pleasing appearance is challenging in view of issue of crazing. This is particularly true when the anodic layer is larger than conventional layers and when the anodic layer has a bend or a curve in it. However, the present techniques help to reduce and/or eliminate crazing, thus producing a smooth and aesthetically pleasing appearance. Additionally, the sealing of the anodic layer closes or reduces the size of the porous in the anodic layer. This helps prevent corrosion of the underlying aluminum. Further, it helps to prevent dis-colorization and/or absorption of substances into the anodic layer that may negatively impact the appearance of the anodic layer.

The foregoing describes some example embodiments for creating and sealing anodized aluminum. Although the foregoing discussion has presented specific embodiments, persons skilled in the art will recognize that changes may be made in form and detail without departing from the spirit and scope of the embodiments. For example, in some embodiments, an anodized aluminum member may be preheated outside of the sealing bath prior to being placed in the sealing bath. Accordingly, the specific embodiments described herein should be understood as examples and not limiting the scope thereof.

What is claimed is:

1. A method for sealing an anodized metal member, comprising:

performing a sealing treatment including:

placing the anodized metal member in a sealing bath having water, the sealing bath having a first temperature that is between about 20 and 40 degrees Celsius, continuously heating the sealing bath from the first temperature to a sealing temperature while the anodized metal member is in the sealing bath, and maintaining the sealing bath at the sealing temperature during a remainder of the sealing treatment; and removing the anodized metal member from the sealing bath after the sealing treatment is complete.

2. The method of claim 1, wherein the sealing treatment occurs for a determined period of time.

3. The method of claim 1, wherein the the first temperature is between about 35 and 40 degrees Celsius.

4. The method of claim 1, wherein the sealing temperature is at least the boiling point of water.

5. The method of claim 1, further comprising adding a sealing agent to the sealing bath.

6. The method of claim 5, wherein the sealing agent comprises nickel acetate.

7. The method of claim 1, wherein the sealing bath is heated by at least one of: an inductive system, a steam system, a radiation system, or an air oven.

8. The method of claim 1, further comprising preheating the anodized metal member prior to placing it in the sealing bath.

9. A method for creating a sealed anodized aluminum member, comprising:

anodizing an aluminum member to form an anodized aluminum member;

rinsing the anodized aluminum member;

dyeing an anodic layer of the anodized aluminum member;

rinsing the dyed anodic layer;

performing a sealing treatment including:

placing the anodized aluminum member in a sealing bath having a first temperature that is between about 20 and 40 degrees Celsius; and while the anodized aluminum member is in the sealing bath, continuously heating the sealing bath from the first temperature to a sealing temperature; and maintaining the sealing bath at the sealing temperature during a remainder of the sealing treatment; and removing the anodized metal member from the sealing bath after the sealing treatment is complete.

10. The method of claim 9, wherein the sealing treatment occurs for a determined period of time.

11. The method of claim 9, wherein anodizing the aluminum member comprises:

placing the aluminum member in an anodizing bath comprising sulfuric acid;

maintaining the anodizing bath at an approximately constant temperature;

conducting a current through the aluminum member; and removing the aluminum member from the anodizing bath when the anodic layer grows to approximately 30 to 40 micrometers thick.

12. The method of claim 9, further comprising preheating the anodized aluminum member prior to placing the anodized aluminum member in the sealing bath.

13. A method for creating an anodized aluminum member for an electronic device, comprising:

placing the anodized aluminum member in a sealing bath having a first temperature that is greater than room temperature and below 40 degrees Celsius;

while the anodized aluminum member is in the sealing bath, raising a temperature of the sealing bath from the first temperature to a sealing temperature; and removing the anodized aluminum member from the sealing bath after the sealing bath has been maintained at the sealing temperature for a determined period of time.

14. The method of claim 13, wherein the temperature of the sealing bath is raised from the first temperature to the sealing temperature at a rate that is associated with a thickness of an anodic layer of the anodized aluminum member.

15. The method of claim 13, further comprising heating the anodized aluminum member prior to placing the anodized aluminum member in the sealing bath.

16. The method of claim 13, wherein the sealing temperature is approximately 100 degrees Celsius.

17. The method of claim 13, further comprising dyeing the anodized aluminum member prior to placing the anodized aluminum member in the sealing bath.

18. The method of claim 17, further comprising rinsing the anodized aluminum member after dyeing the anodized aluminum member and prior to placing the anodized aluminum member in the sealing bath.

19. The method of claim 13, wherein the sealing bath comprises a sealing agent.

* * * * *